United States Patent [19]

Sakamoto et al.

[11] Patent Number: 4,576,463

[45] **Date of Patent: * Mar. 18, 1986**

[54] DEVELOPING APPARATUS FOR ELECTROSTATIC PHOTOGRAPHY

[75] Inventors: Koji Sakamoto; Kazuo Kobayashi, both of Tokyo, Japan

[73] Assignee: Ricoh Company, Ltd., Tokyo, Japan

[ * ] Notice: The portion of the term of this patent subsequent to May 1, 2001 has been disclaimed.

[21] Appl. No.: 603,260

[22] Filed: Apr. 23, 1984

Related U.S. Application Data

[62] Division of Ser. No. 326,098, Nov. 30, 1981, Pat. No. 4,445,771.

[30] Foreign Application Priority Data

Dec. 5, 1980 [JP] Japan ..... 55-170846
Dec. 12, 1980 [JP] Japan ..... 55-174610
Dec. 30, 1980 [JP] Japan ..... 55-185726

[51] Int. Cl.[4] ..... G03G 15/08

[52] U.S. Cl. ..... 355/3 DD; 355/14 D; 118/657

[58] Field of Search ..... 355/3 DD, 14 D, 3 R, 355/14 CH, 3 CH, 15; 118/656, 657, 661, 658, 647, 651; 430/120; 427/203, 205

[56] References Cited

U.S. PATENT DOCUMENTS

Re. 28,566 10/1975 Yang ..... 355/15
4,101,215 7/1978 Fottner et al. ..... 355/15
4,194,830 3/1980 Ohnuma et al. ..... 355/3 DD
4,377,332 3/1983 Tamura ..... 118/658 X
4,378,158 3/1983 Kanbe ..... 355/14 D X

*Primary Examiner*—A. C. Prescott
*Attorney, Agent, or Firm*—David G. Alexander

[57] ABSTRACT

A toner charging member to which a toner is conveyed and supplied is located in the vicinity of a photoconductive element which is to carry an electrostatic latent image thereon. The toner charging member charges the toner conveyed thereto to a selected polarity by friction, so that a thin uniformly charged toner layer is formed on the toner charging member. The charged toner particles are released from the toner layer on the charging member onto the latent image on the photoconductive element.

The toner charging member has an insulating member on its surface. A first discharging means is provided to dissipate accumulated charge on the insulator substantially simultaneously with its operation for removing toner particles from the charging member those which were not been supplied to the latent image. A second discharging means is disposed in a position downstream of a station where the first means removes the residual toner and upstream of a station where the toner is supplied to the charging member, in order to remove the charge from the insulator.

A number of microelectrodes are formed on the toner charging member or on its insulator to attain a prominent edge effect even when use is made of a one component type developer, which consists of toner particles alone.

21 Claims, 23 Drawing Figures

DEVELOPING APPARATUS FOR ELECTROSTATIC PHOTOGRAPHY

This invention is a division of copending U.S. patent application Ser. No. 326,098, filed Nov. 30, 1981 Ser. No. 326,098 is now U.S. Pat. No. 4,445,771.

The present invention relates to an improved developing apparatus for use with an electrophotographic copying machine, an electrostatic recording apparatus or the like of the type which includes a photoconductive drum or like latent image carrying member and a member located adjacent to the latent image carrying member to convey and supply a developer thereto. The developer supplied from the supplying or conveying member to the latent image carrying member is adapted to develop the latent image into a visible toner image.

A developing apparatus of the type described for an electrophotographic copying machine, an electrostatic recording apparatus or the like is well known in the art. Developers usable with this type of developing apparatus are generally classified into two different types, i.e. a one component type consisting of a toner only and a two component type comprising a mixture of a toner and a carrier. Compared to an apparatus using the two component developer, an apparatus employing the one component developer is simpler in construction and more reliable in operation and, for this reason, it has come to attract increasing attention in the industry of electrostatic photography. Various developing methods achievable with such a type of developing apparatus have hitherto been proposed, which may generally belong to two classes: an induction developing method using a toner of a relatively low electric resistance, and a charge developing method using a toner of a relatively high electric resistance and charging the toner by a charging means.

Using no special charging means, the induction developing method causes a layer of toner particles to develop induced charge therein by the charge of an electrostatic latent image and thereby adhere to the latent image. The charge developing method on the other hand relies on a suitable charging means to charge a layer of toner particles to a given polarity and deposite the charged toner particles on an electrostatic latent image. In the charge developing method, a toner may be charged to a selected polarity by either one of three typical implements heretofore known: (a) one in which a blade is held in frictional contact with a toner, (b) one in which the toner conveying or supplying member has its surface kept in frictional contact with the toner which moves thereon, (c) one in which a corona discharger is used, and (d) one in which charge is driven into toner particles from an electrode.

The induction developing method is inferior to the charge developing method with respect to the ease of transfer of toner images to ordinary sheets of paper. In this regard, a developing apparatus using the charge developing method is more desirable than one which relies on the induction developing method. However, a developing apparatus based on the charge developing method still involves a problem which will be described hereinafter.

In order that a clear-cut toner image may be developed from a latent image by the charge developing method, it is preferable to establish a uniform charge distribution throughout the thickness of a toner layer and thereby render the amounts of charge on the individual toner particles as even as possible. For such a uniform charge distribution, it is necessary to form a very thin and uniformly thin layer of toner particles regardless of the kind of the charging method selected (methods (a)-(d)). To meet this need, a prior art developing apparatus using the charge developing method employs a doctor blade which provides a roughly regulated thin layer of toner particles. However, the doctor blade cannot reduce the thickness of the toner layer beyond a certain limit so that the toner layer still fails to be charged to a uniform charge distribution.

It is an object of the present invention to provide an improved developing apparatus which substantially eliminates the drawback inherent in the prior art charge development type developing apparatus and is capable of readily forming a thin and relatively uniformly charged toner layer.

In order to achieve this object, a developing apparatus of the present invention includes a first member for conveying a toner and a second member adjacent to the first member and adapted to charge the toner conveyed by the first member thereto. The second member charges the toner to a predetermined polarity by its friction with the toner whereby the toner is adhered to the second member to form a thin toner layer thereon.

In causing friction between the toner and the charging member, it was confirmed that the frictional charging occurs more effectively when the outer periphery of the charging member is covered with an insulating material. However, the charge resulting from friction tends to accumulate progressively on the insulator as the developing operation is repeated. This brings the actual intensity of electric field in a developing station out of coincidence with desired one, preventing the apparatus to produce toner images of a high quality. The accumulation of charge on the insulator is also reflected by a change in the charging characteristics of the toner, which often obstructs reproduction of favorable toner images.

To settle these problems, there has been proposed a construction in which a discharging means is located to face the toner charging member such that it discharges the insulator on the charging member. Yet, depending on the construction, the discharging means cannot fully expel the charges from the insulator. That is, despite the provision of the special discharging means, charge is unavoidably accumulated on the insulator during repeated developing actions.

It is a second object of the present invention to provide a developing apparatus which substantially eliminates the shortcoming encountered in the prior art discharging means and can discharge the insulator on the charging member in a more effective fashion.

In order to achieve this second object, a developing apparatus of the present invention includes a first discharging means which discharges the insulator substantially simultaneously with its operation for removing residual toner particles from the charging member which were not supplied to a latent image, and a second discharging means for discharging the insulator at a location past of a position where the toner is removed by the first discharging means but ahead of a position where the toner is adhered to the charging member. At least one of the two discharging means is driven to perform the discharging function.

In an electronic copying machine, an electrostatic recording apparatus or the like, a developing apparatus of the type described has to meet different demands depending on the total area of a latent image which it is to process. Generally, an image has a relatively large area when it is a picture image and a relatively small area when it is a line image. In an electronic copier, for example, where an image on an original document is a line image and if its density on the document is relatively low, it is still desired that an image can be reproduced to a density higher than that of the original image. However, in the case of a picture image which is wide, the density of a reproduced image is desired to faithfully correspond to that of the picture image on the document. These two conflicting demands need be satisfied regardless of the type of a developer, i.e. one component type or two component type, or in a developing apparatus for use with any other system such as an electrostatic recording system.

It has been customary to meet such demands by utilizing a so-called edge effect in developing a latent image. The "edge effect" implies a phenomenon that a substantial volume of toner particles becomes adhered to edge portions of a latent image due to an uneven distribution of electric field intensity; the electric field intensity is higher in the edge portions of the latent image than in the central portion. In the case of a latent image which is a line image (hereinafter called a line latent image), it consists of edge portions over its major portion or substantially throughout its area so that an image obtained from the latent image will appear dense relative to the surface potential of the latent image. In the case of a latent image which is a picture image (hereinafter called a picture latent image), the edge effect occurs only in the limited edge portions of the wide latent image and, therefore, a reproduced image will faithfully conform in density to the original image in its area corresponding to the major area of the latent image other than the edge portions. It will thus be seen that if the edge effect is controllable to a desired degree, both of a line image and a picture image can be reproduced each with the ideal required density.

Indeed, the edge effect can be achieved in a relatively positive manner as long as the developing apparatus uses the two component type developer made up of a toner and a carrier. It cannot be expected, however, that the edge effect obtainable with the one component type developer, i.e. toner alone, positively satisfies the two conflicting demands described hereinabove. Various efforts have actually been made to create a favorable edge effect even with a developing apparatus which uses the one component developer. For example, it is known to arrange a photoconductive member and a toner conveying or charging member at a substantial spacing in a developing apparatus of an electronic copying machine. This expedient succeeds in enhancing the edge effect to a certain extent so that line and picture images may be reproduced in the previously defined relation in density. However, such a known expedient invites a significant decrease in the intensity of electric field of a picture latent image, which in turn causes the developing efficiency to undergo a significant fall. Moreover, the edge effect obtainable therewith is effective only for line images of very small total areas.

It is a third object of the present invention to provide a developing apparatus which, despite the use of a one component developer, offers an excellent edge effect to line latent images so that line and picture images can be reproduced each to a desired density without accompanying any decrease in the intensity of electric field of a picture latent image.

In endeavoring to achieve the third object, we extended our study to see why the edge effect is prominent in a developing apparatus using a two component developer but not in a developing apparatus using a one component developer. This led us to the following recognition which is entirely new to the art.

A two component developer contains conductive carrier particles together with toner particles. The carrier contributes a great deal to the edge effect and, particularly, those carrier particles located in the vicinity of the surface of a latent image carrying member (e.g. photoconductive member) play a major role in creating the edge effect. Presumably, this is because the carrier particles in the developer function as electrodes for a latent image on the photoconductive member. When a number of microelectrodes are present in the form of carrier particles, the number of electric lines of force directed from a latent image of a small area (line image) toward background areas on the photoconductive member (where no latent image is formed) grows larger than that which would appear if the microelectrodes were absent. The result is an increase in the intensity of electric field around the surface of the small area latent image and, therefore, the efficient edge effect. Such an effect is unachievable with the one component developer due to the absence of the carrier particles or microelectrodes. Put in another way, this fact suggests that an effective edge effect can be achieved even in the case of the one component developer only if microelectrodes equivalent in function to the carrier particles are present.

In order to achieve the third object, a developing apparatus of the present invention includes a toner carrying or charging member which is positively provided with a number of microelectrodes. With this construction, the desired edge effect is attainable though the developer may be of the one component type consisting of a toner only.

It is another object of the present invention to provide a generally improved developing apparatus for electrostatic photography.

Other objects, together with the foregoing, are attained in the embodiments described in the following description and illustrated in the accompanying drawings.

Figure 10A:
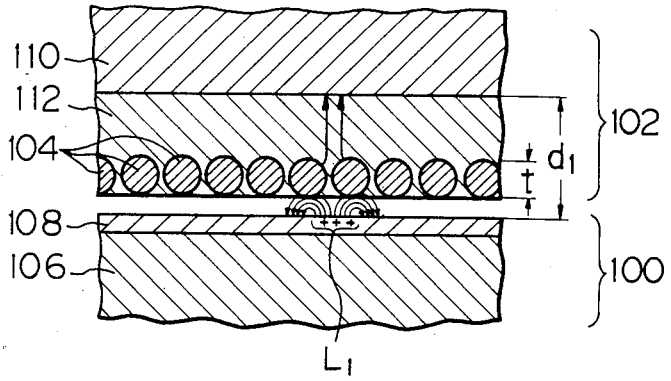
Figure 10B:
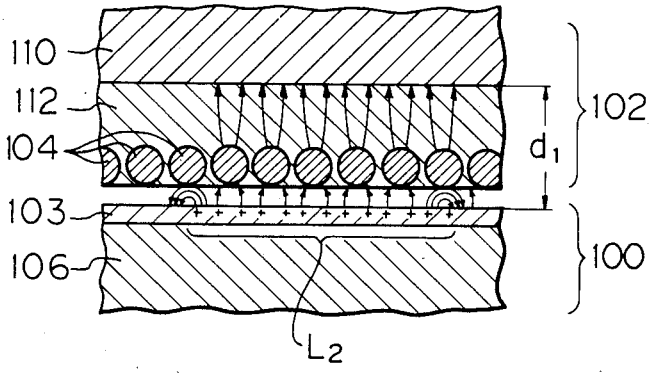
Figure 11A:
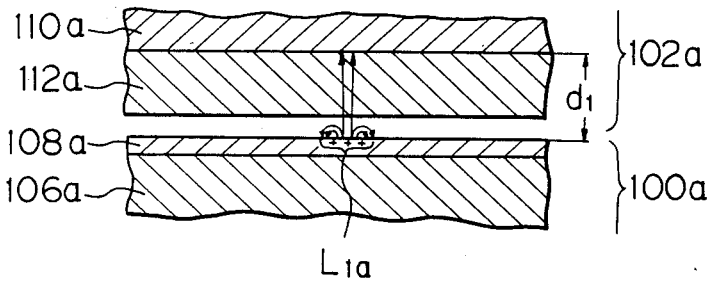
Figure 11B:
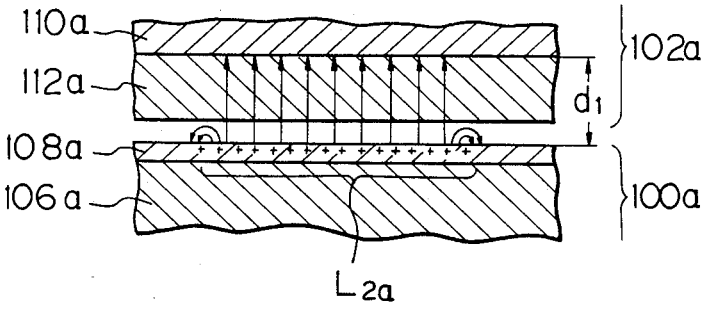
Figure 12:
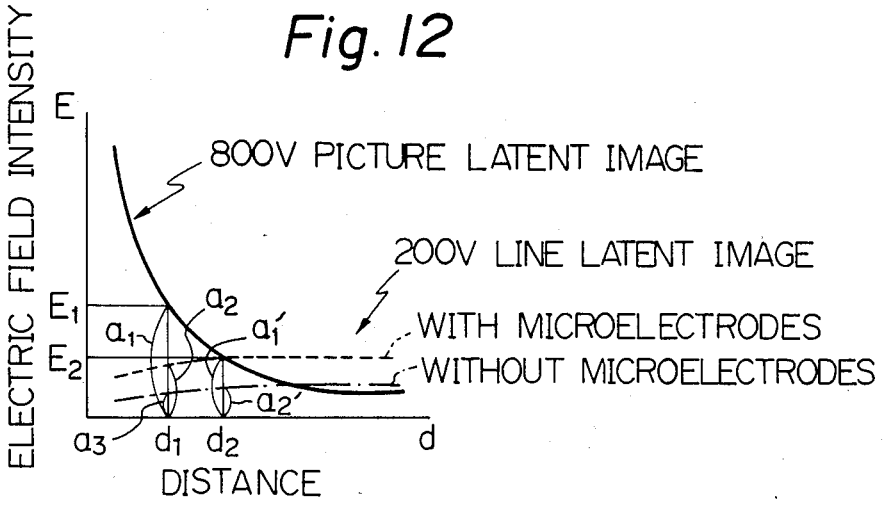
Figure 13:
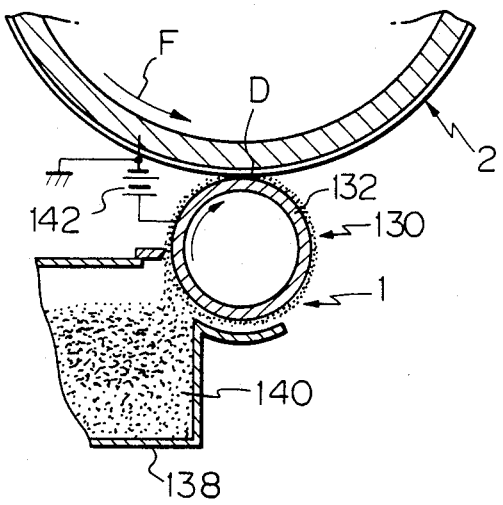
Figure 14:
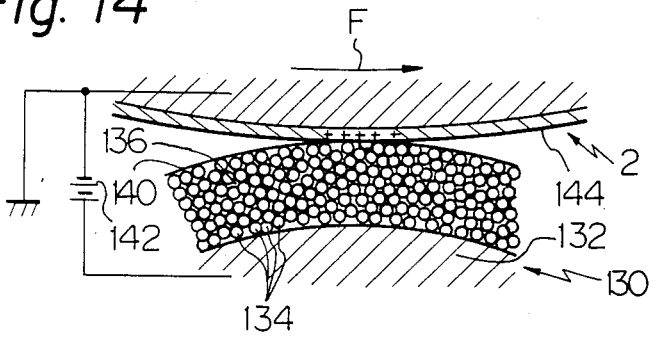
Figure 15:
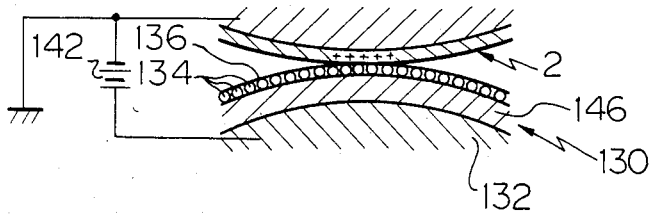
Figure 16:
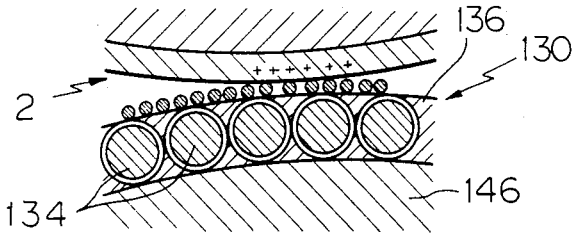
Figure 17:
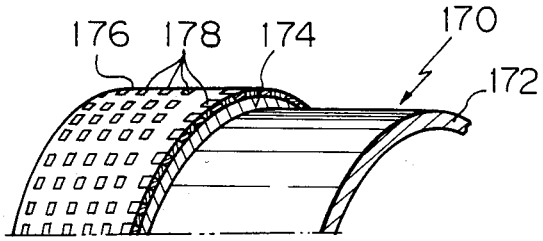
Figure 18:
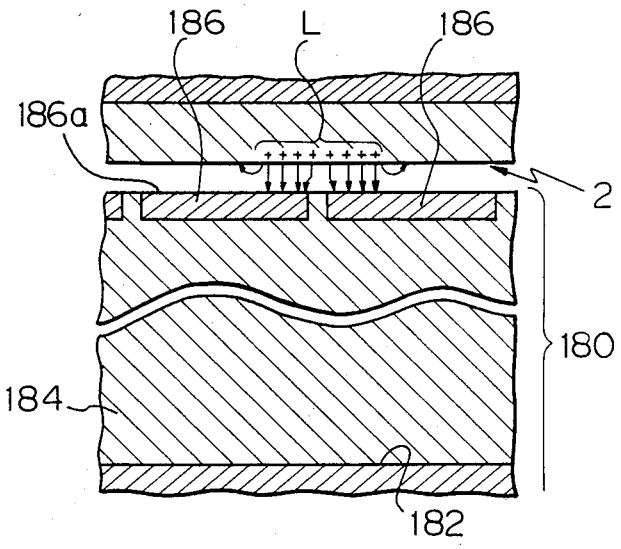
Figure 19:
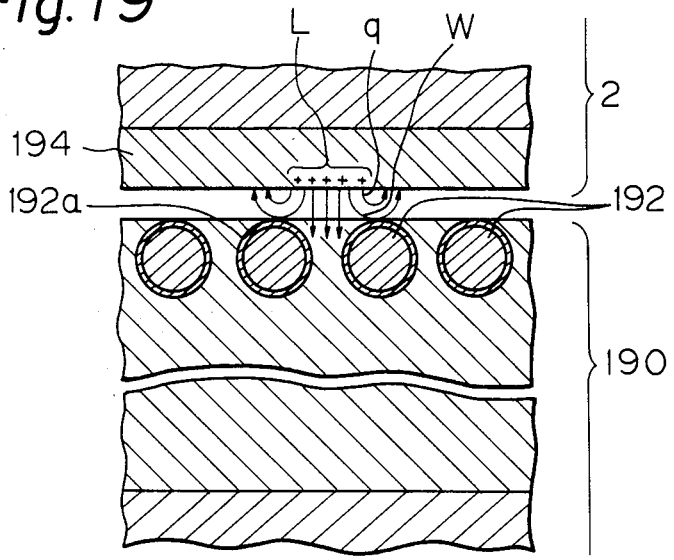
Figure 20:
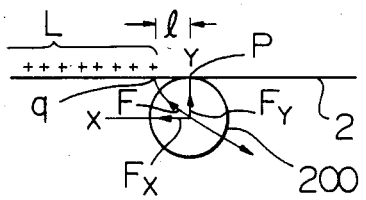
Figure 21:
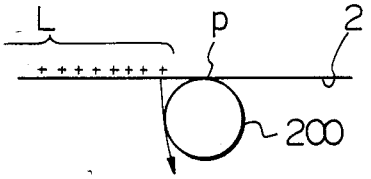

FIGS. 10*a* and 10*b* are schematic diagrams explanatory of an effect achievable with microelectrodes on a toner charging member;

FIGS. 11*a* and 11*b* are views similar to FIGS. 10*a* and 10*b* but showing a prior art toner charging member which lacks the microelectrodes;

FIG. 12 is a graph demonstrating exemplary variations in the intensity of electric field determined by presence/absence of microelectrodes;

FIG. 13 is a section of another embodiment of the present invention which is equipped with a toner charging member having microelectrodes thereon;

FIG. 14 is a fragmentary enlarged view of the developing apparatus shown in FIG. 13;

FIG. 15 is a fragmentary section showing another embodiment of the present invention furnished with microelectrodes;

FIG. 16 is a fragmentary enlarged view of the developing apparatus of FIG. 15;

FIG. 17 is a fragmentary perspective view of a toner charging member provided with an insulating member and microelectrodes thereon;

FIG. 18 is a view of an alternative toner charging member provided with an insulating member and microelectrodes;

FIG. 19 is a view similar to FIG. 18 but showing a farther embodiment of the present invention in which a toner charging member is provided with spherical microelectrodes;

FIG. 20 is a diagram corresponding to FIG. 19 and showing a toner particle which is adhered to an undesired spot on a photoconductive member due to the spherical configuration of the microelectrodes;

FIG. 21 is a diagram corresponding to FIG. 18 and showing a toner particle which is not adhere to the undesired spot on the photoconductive member even under the same conditions as the toner particle of FIG. 20.

While the developing apparatus for electrostatic photography of the present invention is susceptible of numerous physical embodiments, depending upon the environment and requirements of use, substantial numbers of the herein shown and described embodiments have been made, tested and used, and all have performed in an eminently satisfactory manner.

Figure 1:
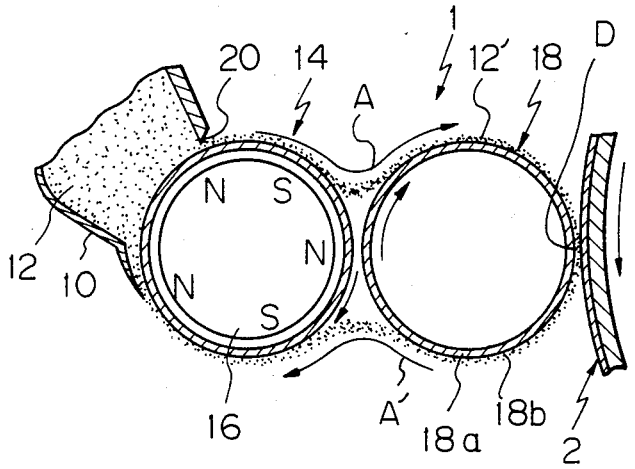
FIG. 1 is a section showing a developing apparatus embodying the present invention which includes a toner conveying member and a toner charging member.

Referring to FIG. 1 of the drawings, there is shown an electrophotographic copying machine to which a developing apparatus of the present invention designed to achieve the previously described first object is applicable. The copying machine includes the developing apparatus generally designated by the reference numeral 1 and a photoconductive member in the form of a dram 2.

The developing apparatus 1 includes a reservoir 10 which stores therein a one component type developer, i. e. a magnetic toner 12. A toner conveying sleeve 14 is associated with the reservoir 10 to convey the toner 12 out from the reservoir 10. A magnet 16 is accommodated within the sleeve 14 to cooperate with the sleeve 14. A toner charging sleeve 18 is interposed between the conveying sleeve 14 and the photoconductive drum 2 to deposite a charge on the toner 12 by friction. The toner 12 is of the type having a relatively high electric resistance and its volume specific resistance may be larger than $10^{10}$ Ω-cm for example, preferably larger than $10^{13}$ Ω-cm.

The conveying sleeve 14 is made of a non-magnetic material and located to face a toner inlet/outlet of the reservoir 10. The charging sleeve 18 neighbors the conveying sleeve 14 in parallel while the drum 2 is positioned in parallel with the sleeve 18 in contact with or slightly spaced from the latter. In the illustrated embodiment, the magnet 16 inside the sleeve 14 is fixed in place whereas the sleeve 14 is rotatable counterclockwise relative to the magnet 16; the sleeve 18 is also rotatable counterclockwise.

During a copying cycle of the copier, the drum 2 is driven for counterclockwise rotation as indicated by an arrow in the drawing. An electrostatic latent image is formed on the surface of the rotating drum 2 by a known latent image forming device (not shown). In accordance with the rotation of the drum 2, the latent image is moved to a station D where the drum 2 contacts or is the closest to the charging sleeve 18. This specific station D will be referred to as a developing station hereinafter. Though the charge polarity on the latent image may be either positive or negative, it is assumed herein that a latent image is formed by negative charge by way of example.

Meanwhile, the sleeves 14 and 18 are driven for counterclockwise rotation by a drive mechanism (not shown). The sleeve 14 carries the toner 12 out of the reservoir 10 in cooperation with the stationary magnet 16 located thereinside. The toner 12 forms a magnetic brush and is progressively conveyed by the sleeve 14 in the counterclockwise direction. The polarities S and N of the magnet 16 are so arranged as to provide such a function as indicated in FIG. 1. A doctor blade 20 is positioned to face the sleeve 14 such that it roughly regulates the thickness of the toner layer on the sleeve 14.

The sleeve 14 conveys the toner 12 in the direction indicated by an arrow A to a position where it adjoins the neighboring sleeve 18. Then, the toner 12 is brought into contact with the surface of the sleeve 18 and thereby partly deposited with charges under friction. Particles of the toner 12 charged to a level higher than a predetermined level are released from the magnetic field developed by the magnet 16 and allowed to transfer from the surface of the sleeve 14 to that of the sleeve 18.

Such frictional charges on the toner 12 are achievable with a unique construction of the charging sleeve 18. As shown, the sleeve 18 comprises a conductive support member 18*a* and an outer layer 18*b* formed on the outer surface of the conductive support member 18*a*. The outer layer 18*b* is formed of a suitable material which can charge the toner 12 to a desired polarity, which is positive in the illustrated embodiment.

The toner 12 now adhered to the surface of the sleeve 18 is conveyed by the sleeve 18 which is in counterclockwise rotation, until it reaches the developing station D. At this station D, the toner 12 contacts or substantially contacts the surface of the rotating drum 2 to be electrostatically adhered to the latent image carried on the drum 2. The latent image thus developed by the toner 12 is moved farther to a transfer station where it will be transferred onto a paper sheet as a toner image by an image transfer unit (not shown).

Thus, the toner 12 of a high resistance is conveyed by the sleeve 14 under magnetism and then frictionally charged by the adjacent sleeve 18. Between the sleeves 14, 18, there are developed an electric field attributable to the frictional charging and a magnetic field attributable to the magnet 16. This subjects the toner 12 to oppositely directed attractive forces and permits only those toner particles charged beyond a given charge level to transfer from the sleeve 14 to the sleeve 18. Accordingly, a toner layer 12' made up of toner particles 12 of a given charge amount is formed on the surface of the sleeve 18. Stated another way, the individual toner particles 12 constituting the toner layer 12' can have a substantially uniform amount of charge to eventually establish an even charge distribution throughout the toner layer 12'. Additionally, the intensities of the magnetic and electric fields mentioned above can be controlled as desired by suitably selecting the kind and/or type of the outer layer **18*b* of the sleeve 18 and the magnet 16. This in turn makes it possible to readily adjust the amount of toner particles 12 on the sleeve 18 and, therefore, the thickness of the toner layer 12' as desired. These in combination allow a thin uniformly charged toner layer 12' to be deposited on the sleeve 18** to offer clear-cut toner images on copy sheets.

In the arrangement shown in FIG. 1, the part of the toner 12 which was not transferred to the sleeve 18 is further conveyed counterclockwise by the sleeve 14 to be collected again in the reservoir 10. The sleeve 18 is designed to deposite the toner 12 directly therefrom onto the latent image on the drum 2 and, therefore, to bifunction as a developing roller. In such a case, a positive or negative bias voltage may be applied to the conductive support **18*a* of the roller 18 in accordance with a potential on the background areas of the drum surface, so that the toner 12 can be prevented from accidentally adhering to the background areas. It will be needless to mention that even in such a situation an arrangement should be so made as to cause frictional charging between the sleeve 18 and the toner 12 which allows a given amount of toner 12 to adhere to the sleeve 18. The outer layer 18*b* of the sleeve 18** is charged by the frictional charging to the polarity common to that of the latent image; this charge may be utilized as a bias voltage for preventing the deposition of the toner on the background areas.

In the developing apparatus 1, the outer layer **18*b* of the sleeve 18 may be made of an insulator so that the sleeve 18** can charge the toner particles more effectively. This, however, accompanies progressive accumulation of unwanted charges on the insulator with the lapse of time, which would adversely affect the charging of toner particles. Therefore, some implement must be employed in such a case to fully discharge the insulator.

Reference will now be made to FIGS. 2–7 for describing a second embodiment of the present invention which can effectively remove such undesirable charges which would be accumulated on the insulator. In FIGS. 2–7, parts and elements common to those shown in FIG. 1 are denoted by the same reference numerals.

Figure 2:
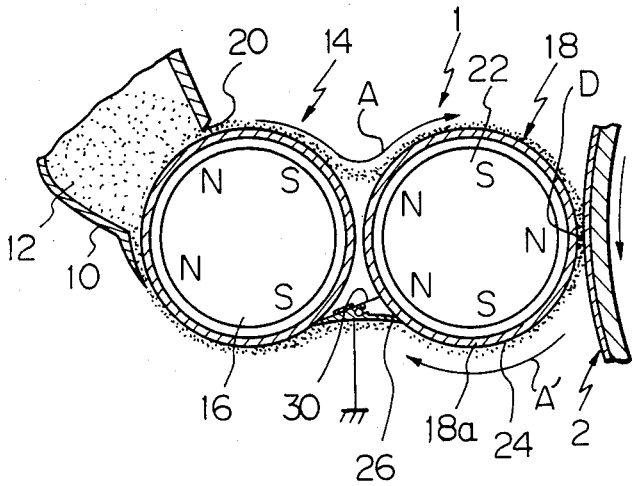
FIG. 2 is a section showing another embodiment of the present invention which includes a toner charging member with an insulator thereon and means for discharging the insulator.

As shown in FIG. 2, a second magnet 22 is fixed in place within the charging sleeve 18 in the same way as the magnet 16 inside the conveying sleeve 15. As in the first embodiment, the toner 12 is fed from the reservoir 10 to the sleeve 18 via the sleeve 14. The sleeve 18 in this embodiment has on its conductive support member **18*a* an insulating layer 24 adapted to frictionally charge the toner 12. In detail, the insulating layer 24 charges the toner 12 by friction to a polarity opposite to that of a latent image on the drum 2, which is the positive polarity in this embodiment since the latent image is assumed to have the negative polarity. Thus, the layer 24** is made of a suitable material which serves this function such as Teflon resin.

Charged to the positive polarity by the insulator 24 under friction, the toner 12 is conveyed by the sleeve 18 to the developing station D to the electrostatically shifted to a negative latent image on the drum 2. The residual part of the toner 12 on the sleeve 18 which did not join in the development is moved past the developing station D as indicated by an arrow A' and then fed back to the reservoir 10 via the intermediate sleeve 14.

The transfer of the toner 12 from the sleeve 18 back to the sleeve 14 is effected by the magnetic forces exerted by the magnets 22 and 16 inside the sleeves 18 and 14, respectively. However, the magnetic forces of the magnets 22 and 16 are not strong enough to fully shift the toner 12 from the sleeve 18 to the sleeve 14 without allowing any part thereof to remain on the sleeve 18. The residual toner on the sleeve 18 would accumulate progressively thereon with the lapse of time to obstruct reproduction of quality images. In this embodiment of the present invention, a scraper blade 26 is fixedly supported to pressingly contact the sleeves 18 and 14 at its opposite ends, respectively (see FIG. 3). This blade 26 serves to effectively scrape off the toner 12 from the surface of the blade 18 and transfer it to the sleeve 14 therealong.

With the construction and operation described hereinabove, charge tends to progressively accumulate on the insulator 24 on the sleeve 18 as a copying cycle of the copier is repeated, deteriorating the quality of reproduced images. As previously stated, there have already been proposed some discharging means which are located outside the charging sleeve 18. An example of such prior art discharging means is illustrated in FIG. 4.

Figure 4:
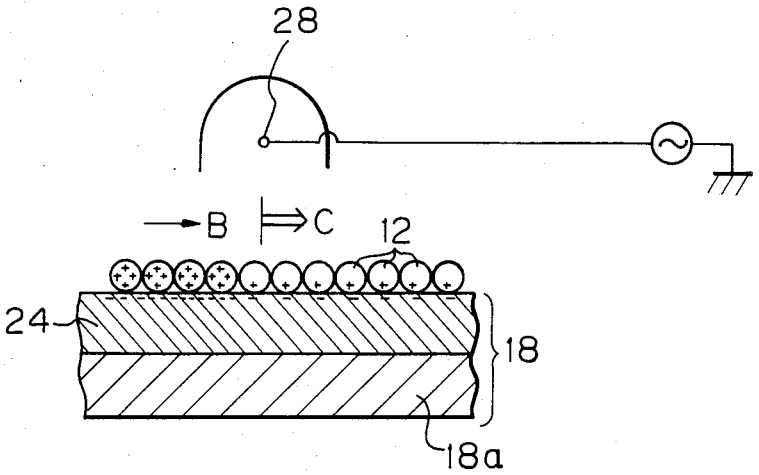
FIG. 4 is a diagram illustrating the principle of operation of a discharging means which is employed for a prior art developing apparatus.

Referring to FIG. 4, the charging sleeve 18 comprises a conductive support member **18*a* and an insulating layer 24 formed on the conductive support 18*a* in the same way as the sleeve 18 in FIG. 2. Toner particles 12 are carried on the insulator 24 of the sleeve 18. A discharging means in the form of a corona discharger 28 is disposed above the toner particles 12, that is, the sleeve 18 carrying the toner 12 is moved below the discharger 28 in a direction indicated by an arrow B. The discharger 28 is energized to expel the charge from each portion of the insulator 24 which moves past the discharger 28. Observation shows that the surface potential is actually reduced substantially to zero in a region C downstream of the discharger 28 with respect to the direction of rotation of the sleeve 18. Nevertheless, charges of opposite polarities are present as pairs in the toner particles 12 and insulator 24 even in the region C concerned. It follows that the insulator 24 cannot release its charge when the toner particles 12 are removed from the sleeve 18, the charge being accumulated progressively as the time passes by. This is the reason why the discharging means shown in FIG. 4 fails to fully expel the charges from the insulator 24**.

The arrangement shown in FIG. 2 is constructed on the basis of such unique recognition discussed above with reference to FIG. 4. In the prior art construction, paring charges remain in the toner particles and insulator even after a discharging operation, because the discharger is located above the toner particles. This implies that no residual charges would be allowed on the insulator if the insulator were discharged at the same time or after the removal of the toner particles from the charging sleeve. In FIG. 2, the scraper blade 26 is made of a conductive material and grounded. The scraper blade 26 grounds the insulator 24 of the sleeve 18 to effectively discharge it while removing toner particles from the insulator 24.

Figure 3:
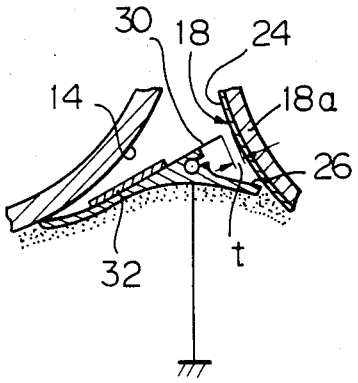
FIG. 3 is a fragmentary enlarged view of the developing apparatus shown in FIG. 2.

Without any assistance, the scraper blade 26 might fail to completely dissipate the charge from the surface of the charging sleeve 18. With this in view, the arrangement of FIG. 2 further includes a second discharging means in the form a discharging brush 30. As best shown in FIG. 3, the discharging brush 30 is fixedly attached to the scraper blade 26 by a retainer 32 and is grounded together with the blade 26. The discharging brush 30 has its free end located within a range downstream of a portion of the sleeve 18 where toner particles are substantially absent, that is, a portion where toner particles are removed by the scraper blade 26, but upstream of a portion where a fresh supply of toner particles is transferred from the sleeve 14 to the sleeve 18. With this construction and arrangement, the discharging brush 30 can discharge the insulator 24 effectively without any such problem discussed in connection with FIG. 4. As will be noted, the free end of the brush 30 may be held in contact with the surface of the sleeve 18 or, as shown in FIG. 3, spaced a small distance t from the surface of the sleeve 18. Where the brush 30 is spaced the distance t from the sleeve 18, the insulator 24 is discharged by a discharge which will develop from the insulator 24 to the free end of the brush 30. An advantage originating from such a spaced location of the brush 30 is that wear of the brush 30 and insulator 24 attributable to their friction can be avoided. It will be seen that a plurality of discharging brushes 30 may be positioned within the previously defined range around the sleeve 18 if a single brush 30 cannot suffice for complete discharging of the insulator 24.

Either one of the scraper blade 26 and discharging brush 30 may be omitted though both of them are employed as first and second discharging means in the embodiment shown and described. It is permissible to form the first and second discharging means as a single integral member. The discharging means are not limited to the blade and brush but may comprise any other suitable discharging means such as corona dischargers.

Apart from a developing apparatus of the type described hereinabove, it will be seen that the principle of the present invention is applicable to another type of developing apparatus which supplies a developer directly from a reservoir to a charging sleeve without the intermediary of a conveying sleeve. Such an application of the present invention will be described with reference to FIG. 5.

Figure 5:
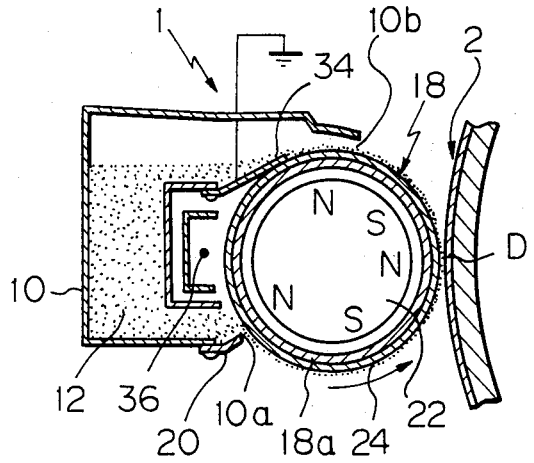
FIG. 5 is a section showing another embodiment of the present invention which is different from that of FIG. 2.

Referring to FIG. 5, the charging sleeve 18 is rotated counterclockwise to magnetically carry the toner 12 out from the reservoir 10 through an outlet 10*a* of the latter. In the developing station D, the toner 12 is electrostatically deposited on a latent image carried on the drum 2. A residual part of the toner 12 is moved past the developing station D until it becomes removed from the sleeve 18 by a conductive scraper blade 34. This scraper blade 34 is grounded so that it functions as a first discharging means for discharging the insulator 24 on the sleeve 18. This first discharging means is assisted by a second discharging means which comprises at least one corona discharger 36 located between the outlet 10*a* and an inlet 10*b* of the reservoir 10 to additionally discharge the insulator 24. The rest of the construction shown in FIG. 5 is essentially similar to the construction of FIG. 2, like reference numerals denoting like parts and elements.

Figure 6:
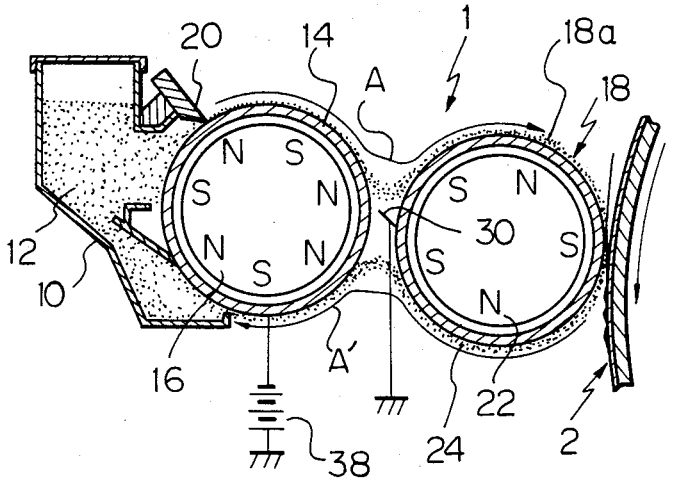
FIG. 6 is a section showing another embodiment of the present invention which is also different from that of FIG. 2.

FIG. 6 illustrates another embodiment of the present invention which is essentially similar to that of FIG. 2 except that the scraper blade 26 for the removal of toner particles is omitted and, instead, a potential difference is set up between the charging sleeve 18 and the conveying sleeve 14 to subject the toner 12 returning from the sleeve 18 back to the sleeve 14 to an electric force directed toward the sleeve 14. For the potential difference, a power source 38 is connected with the conveying roller 14 to couple a voltage thereto. The toner transfer from the sleeve 18 to the sleeve 14 based on the electric force is as efficient as that which employs the scraper blade 26. At least one discharging means in the form of a discharging brush 30 or a blade is disposed in a position around the sleeve 18 where substantially no toner particle is adhered to the sleeve 18. The brush or blade 30 effectively removes the charge from the insulator 24 on the sleeve 18.

The present invention has been shown and described in connection with a developing apparatus in which a charging roller has on its surface an insulating layer for frictionally charging toner particles to a selected polarity. Besides this type of developing apparatus, the present invention is naturally applicable to a developing apparatus in which a charging roller is provided with an insulating layer for a different purpose.

Figure 7:
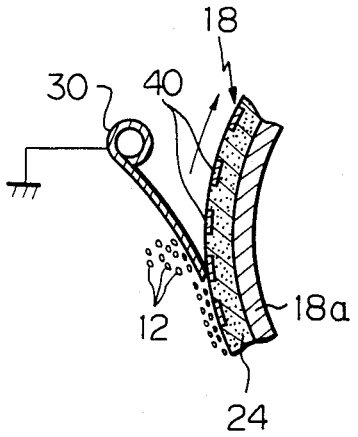
FIG. 7 is a fragmentary section showing an embodiment different from that of FIG. 2 which is furnished with a toner charging member and a means for discharging the toner charging member.

For example, the charging sleeve 18 shown in FIG. 7 comprises a conductive support member 18*a*, an insulating layer 24 on the conductive support 18*a* and a number of microelectrodes 40 embedded in the insulating layer 24. In this case, the insulator 24 serves to insulate the microelectrodes 40 from each other and from the conductive support 18*a*. In this type of sleeve 18, the microelectrodes 40 function to offer an effective edge effect to latent images of relatively small areas, so that sharp and dense toner images can be reproduced from the latent images. Again, accumulation of charges on the insulator 24 leads to degradation of the developing quality. To cope with this problem, a discharging means comprising a blade 30, a brush (not shown) or a corona discharger (not shown) may be positioned as shown in FIG. 7 in the same manner as the embodiment of FIG. 2, 5 or 6 to thereby effectively remove the charge from the insulator 24. The edge effect achievable with the microelectrodes on the charging sleeve will be described later in detail.

Concerning a charging sleeve without microelectrodes, it will be seen from the foregoing that provision of an insulator thereon make it possible: to adjust the intensity of an electric field in the developing station, to cause the sleeve to frictionally charge toner particles fed from a conveying sleeve so that the toner particles may transfer from the conveying sleeve to the charging sleeve, or to generate induced charges on the toner particles on the conveying sleeve to shift the toner particles onto the charging sleeve. When the charging sleeve is furnished with an insulator for such a purpose, the present invention is advantageously applicable to prevent charges from accumulating on the insulator.

In the embodiments of FIGS. 2 and 6, the toner on the charging sleeve 18 is removed forcibly by the scraper blade 26 or the power source 38. It will be seen that the present invention is also applicable to an apparatus which employs simple magnetism instead of the forcible toner removing means.

Figure 8:
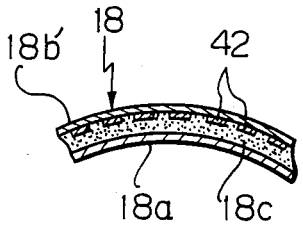
FIG. 8 is a fragmentary section of a toner charging means which bifunctions as a developing roller and has microelectrodes thereon.

In an alternative embodiment shown in FIG. 8, the charging sleeve 18 which bifunctions as a developing roller as described is made up of a conductive support member 18*a*, a number of microelectrodes 42 supported on and insulated from the conductive support 18*a*, an insulating layer 18*c* adapted to insulate the microelectrodes 42 from each other, and an outermost layer 18*b'* covering the microelectrodes 42 and insulator 18*c* to charge toner particles by friction (e.g. Teflon film). With this type of sleeve 18, a uniformly charged layer of toner particles can be formed on the sleeve 18. Such a sleeve 18 feature another advantage that as previously stated the microelectrodes 42 offers a desirable edge effect to latent images of small areas, promoting reproduction of clear-cut toner images from the latent images.

Now, reference will be made to FIGS. 9–21 for describing how the microelectrodes on the charging roller create the effective edge effect.

Figure 9:
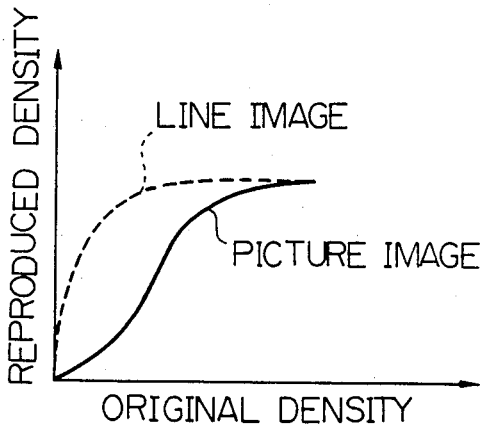
FIG. 9 is a graph representing a relationship in density between an image on an original document and an image reproduced from the original image.

Referring to FIG. 9, there is shown a graph whose abscissa indicates the density of an image carried on an original document and ordinate indicates the density of a reproduced image. A solid curve in FIG. 9 represents an exemplary relationship in density between an original image and a reproduced image as is required for a picture image. Likewise, a dotted curve represents an exemplary relationship in density between an original image and a reproduced image as is required for a line image. As shown, the dotted curve builds up more sharply than the solid curve. As previously discussed, a line image on an original document needs be reproduced to a relatively high density even though it may appear relatively light on the document. A picture image on the other hand has to be reproduced to a density which is substantially proportional to its density on a document.

FIGS. 10*a* and 10*b* are schematic diagrams demonstrating a relationship between a photoconductive member 100, a toner charging member 102 of a developing apparatus, and microelectrodes 104 which will be described. It should be born in mind that the dimensional relation between the individual portions in FIGS. 10*a* and 10*b* is only illustrative and, therefore, different from practical one. The photoconductive member 100 and toner charging member 102 are positioned to face each other. The photoconductive member 100 comprises a conductive base 106 and a photoconductive layer 108 deposited on the surface of the base 106. The toner charging member 102 functions to convey a toner to the developing station between it and the photoconductive member 100 as shown in FIGS. 10*a* and 10*b*. Though not shown for clarity of illustration, toner particles carried by the toner charging member 102 are positioned in the gap between the charging member 102 and the photoconductive layer 108. The photoconductive layer 108 is formed electrostatically with a latent image $L_1$ or $L_2$ by positive charges. Whereas the latent image $L_1$ in FIG. 10*a* represents a line latent image whose area is comparatively small, the latent image $L_2$ in FIG. 10*b* represents a picture latent image whose area is comparatively large.

The toner charging member 102 comprises a conductive support member 110 which serves the function of a developing electrode. In accordance with the present invention, a number of microelectrodes 104 formed of iron or like conductor are fitted to the conductive support 110. An insulating layer 112 is employed to insulate the microelectrodes 104 from each other and from the conductive support 110. Positioned adjacent to the photoconductive member 100, each of the microelectrodes 104 has a diameter which is as small as 10–500 microns, for example.

FIGS. 11*a* and 11*b* indicate an example of a prior art toner charging member 102*a* which faces a photoconductive member 100*a*. This toner charging member 102*a* is constructed in the same way as the toner charging member 102 of FIGS. 10*a* and 10*b* except that it lacks the microelectrodes 104. The rest of the arrangement of FIGS. 11*a* and 11*b* is also the same as that of FIGS. 10*a* and 10*b*; the portions corresponding to those of FIGS. 10*a* and 10*b* are designated by the same reference numerals with a suffix "a". It is assumed herein that the distance $d_1$ between the conductive support 110 and the photoconductive layer 108 in FIGS. 10*a* and 10*b* is equal to the distance $d_1$ between the conductive support 110*a* and the photoconductive layer 108*a* in FIGS. 11*a* and 11*b* (with the thickness t of the microelectrodes in FIGS. 10*a* and 10*b* neglected).

As well known in the art, in the construction shown in FIGS. 10*a* and 10*b* or 11*a* and 11*b*, toner particles (not shown) positioned between the toner charging member 102, 102*a* and the photoconductive member 100, 100*a* are charged to a polarity opposite to the polarity of a charge of the latent image $L_1$, $L_2$ or $L_{1a}$, $L_{2a}$, i.e. negative polarity in the case of FIGS. 10*a*, 10*b* or 11*a*, 11*b*. The negatively charged toner particles are electrostatically adhered to the latent image on the photoconductive layer 108, 108*a* to develop the latent image into a visible toner image. The amount of toner particles adhering to the latent image is greatly affected by the intensity of an electric field in the vicinity of the surface of the photoconductive layer 108, 108*a*. The more intense the electric filed, the larger the amount of toner deposition on the latent image and, therefore, the larger the density of the resultant toner image. Hereinafter will be analyzed the intensity of electric field developed by each of the latent images $L_1$, $L_2$ and $L_{1a}$, $L_{2a}$. To avoid cluttering the description, let it be assumed that the surface potential of the latent image $L_1$ of FIG. 10*a* is common to that of the latent image $L_{1a}$ of FIG. 11*a* while the surface potential of the latent image $L_2$ of FIG. 10*b* is common to that of the latent image $L_{2a}$ of FIG. 11*b*.

In the prior art developing apparatus shown in FIGS. 11*a* and 11*b*, suppose that the latent image on the photoconductive member 100*b* is a line image $L_{1a}$ whose total area is relatively small. Then, the electric lines of force emitted from the latent image $L_{1a}$ are partly directed to the background areas on the photoconductive layer 108*a* and partly to the conductive support 110*a* of the charging member 102*a*. This flow of the electric lines of force toward the background areas creates the edge effect which intensifies the electric field around the surface of the latent image. In this manner, even a prior art developing apparatus using a one component type developer succeeds in achieving some edge effect, but only to a limited or insufficient extent. In contrast, in the construction shown in FIG. 10*a*, the microelectrodes 104 adjacent to the photoconductive layer 108 resemble in function the carrier particles of a two component type developer, whereby the number of electric lines of force directed to the background areas on the photoconductive layer 110 is made remarkably larger than that obtainable with the construction of FIG. 11*a* to offer a prominent edge effect. In other words, the electric field around the surface of the latent image $L_1$ in FIG. 10*a* is far more intense than that around the surface of the latent image $L_{1a}$ in FIG. 11*a*, permitting a larger amount of toner to become deposited on the latent image $L_1$. Thus, a toner image resulting from the latent image $L_1$ will be higher in density than a toner image resulting from the latent image $L_{1a}$.

Concerning the picture latent image of a larger total area shown in FIG. 10*b*, a major part of the electric lines of force emanating from a central region of the latent image $L_2$ is directed to the conductive support 110 which functions as a developing electrode as already stated. This flow of electric lines of force results from the fact that the dielectric thickness between the central region of the latent image $L_2$ and the background area on the photoconductive layer 108 is smaller than the dielectric thickness between the same region of the latent image and the conductive support 110. Likewise, a major part of the electric lines of force emanating from the picture latent image $L_{2a}$ of FIG. 11*b* except for its edge portions is directed toward the conductive support 110*a*. Where the distances $d_1$ are the same and the surface potentials on the picture latent images $L_2$ and $L_{2a}$ are also the same as previously assumed, the electric field around the surface of the latent image $L_2$ is substantially the same in intensity as the electric field around the surface of the latent image $L_{2a}$. It will therefore be seen that for a relatively wide latent image the present/absence of the microelectrodes 104 has no significant influence on the intensity of the electric field; the microelectrodes 104 do not significantly reduce the intensity of the electric field around the surface of the latent image $L_2$ compared to that around the latent image $L_{2a}$.

As will be appreciated from the above, the construction with microelectrodes can intensify the electric field of a latent image beyond that obtainable with the prior art construction, in the case where the latent image is a line image. Yet, in the case of a picture latent image, the construction of the invention hardly lowers the intensity of its electric field relative to one provided by the prior art construction. In short, the density ratio between reproduced picture and line images can coincide with that represented by exemplary curves in FIG. 9, without reducing the electric field intensity of a picture latent image.

FIG. 12 shows curves representing the difference between the arrangement of the invention shown in FIGS. 10*a* and 10*b* and that of the prior art shown in FIGS. 11*a* and 11*b*. In FIG. 12, the ordinate indicates the intensity of electric field E (V/m) in the vicinity of a latent image and in a direction perpendicular to the latent image, and the abscissa indicates the distance d from the surface of the photoconductive layer 108, 108*a* to the conductive support 110, 110*a* (excluding the thickness t of the microelectrodes 104). Each of the dash-and-dot curve and dotted curve represents a relationship between the electric field intensity of a line latent image having a surface potential of 200 V and the distance d; the former corresponding to FIG. 11*a* where the microelectrodes 104 are absent and the latter to FIG. 10*a* where the microelectrodes 104 are present. The solid curve shows a relationship between the electric field intensity E of a picture latent image having a surface potential of 800 V (an area other than edge portions) and the distance d. Whether or not the microelectrodes 104 are present, substantially the same relationship between the electric field intensity E and the distance d applies to the latent images $L_2$ and $L_{2a}$ as indicated by the solid curve.

The graph of FIG. 12 was obtained not by calculation directly using the apparatuses of FIGS. 10 and 11 but by calculation based on simulation. For the calculation, it was assumed that the substances (including air) between the surface of the photoconductive layer 108 and the conductive support 110 in FIGS. 10*a*, 10*b* has the same dielectric constant as the substances between the photoconductive layer 108*a* and the conductive support 110*a* in FIGS. 11*a*, 11*b*. Other assumptive conditions for the calculation were that the photoconductive layer 108, 108*a* had a specific inductive capacity of 3.0, and a thickness of 20 microns, that the substances between the photoconductive layer 108, 108*a* and the conductive support 110, 110*a* had a specific inductive capacity of 2.0, that each microelectrode 104 consisted of a metal piece having a diameter of 80 microns, and that the spacing between neighboring microelectrodes 104 was 20 microns.

Comparing the dotted and dash-and-dot curves of FIG. 12, it will be apparent that the electric field at the surface of the line latent image is far more intense with the microelectrodes 104 than without the same, regardless of the distance d. As already discussed with reference to FIGS. 10*a*, 10*b* and 11*a*, 11*b*, as such is attributable to the prominent edge effect originating from the microelectrodes. In the case of a picture latent image on the other hand, substantially the same relationship between the distance d and the electric field intensity E holds as indicated by the solid curve, with no regard to the microelectrodes 104.

As previously stated, the density ratio between a reproduced picture image and a reproduced line image should preferably have a predetermined value as indicated in FIG. 9, for example. This density ratio corresponds to the electric field intensity ratio between the individual latent images. Let us apply this relation to the graph of FIG. 12. In the arrangement of the present invention with the microelectrodes 104, suppose that the specific density ratio, that is, the specific electric field intensity ratio between a picture latent image and a line latent image is attained at a distance $d_1$ of FIG. 2, and that the electric fields of that instant are at a ratio $X=a_1/a_2$. In this instance, the picture latent image has an electric field intensity $E_1$.

In the prior art construction of FIGS. 11*a*, 11*b* void of the microelectrodes 104, also suppose that the distance providing the specific ratio is $d_1$. Then, the picture and line latent images have electric field intensities which are at a ratio $a_1/a_3$. This differs a great deal from the aforementioned ratio X ($=a_1/a_2$) which provides the desired density ratio.

Thus, where the conductive support and photoconductive layer are commonly spaced a distance $d_1$ both in FIGS. 10*a*, 10*b* and 11*a*, 11*b*, the prior art apparatus shown in FIGS. 11*a* and 11*b* fails to achieve a sufficient edge effect in a picture image and lowers the electric field intensity $a_3$ very much. As a result, it cannot obtain the desired electric field intensity ratio X or the desired density ratio such as one shown in FIG. 9. In contrast, the apparatus of the present invention can exert an effective edge effect on a picture latent image to positively achieve the desired electric field intensity ratio X.

We are well informed about a proposal made in the past to increase the distance d for settling the problem inherent in the above-described prior art arrangement. Describing in connection with FIG. 12, this proposal is to increase the specific distance from $d_1$ to $d_2$ so that the electric field intensity ratio ($a_1'/a_2'$) between a picture latent image and a line latent image may coincide with the value X. This is fact succeeds in establishing an equation $X=a_1/a_2=a_1'/a_2'$ and, in addition, in intensifying the electric field of a line latent image though a little. However, as seen from FIG. 12, the electric field intensity of the picture latent image becomes $E_2$ which is far lower than the previously mentioned intensity $E_1$ and leads to a significant fall of the developing efficiency. In short, in the prior art arrangement, should the distance be set at $d_1$ to intensify the electric field of a picture latent image to $E_1$, for example, the desired electric field intensity ratio X would be unachievable; should the distance d be increased from $d_1$ to $d_2$ to overcome said problem, the developing efficiency would in turn be deteriorated.

It will be understood from the above description that the arrangement of the present invention can approximate the density ratio between reproduced picture and line images to a desired density ratio without any decrease in the electric field intensity of a picture latent image as would occur in the prior art arrangement.

Some more concrete embodiments of the present invention with microelectrodes will be described hereinafter.

Referring to FIG. 13, there is shown a developing apparatus which uses a one component type developer the single component of which is a toner having a relatively high electric resistance (e.g. volume specific resistance higher than $10^{10}$ Ω-cm, particularly higher than $10^{13}$ Ω-cm). The developing apparatus generally designated by the reference numeral 1 is located in face-to-face relation with the photoconductive drum 2. The apparatus 1 includes a toner charging sleeve 130 which faces the drum 2 and has a cylindrical conductive support member 132. As shown in FIG. 14, the outer periphery of the conductive support 132 is covered with a layer of microelectrodes 134 which comprises an iron powder having a particle size distribution of 10–500 microns for example, preferably 100 microns. The microelectrodes 134 are first individually coated with an insulating resinous material whose film thickness is several microns and then mounted on the conductive support 132 by an insulating material 136, which comprises the same resinous material as the coating. The insulating layer 136 may be about 1.5 mm thick, for example.

Upon the start of a copying cycle, the charging sleeve 130 is driven for clockwise rotation as viewed in FIG. 13 to be supplied with a toner 140 from a reservoir 138. The toner 140 consists of non-magnetic particles having a relatively high electric resistance. While being carried on the sleeve 130, the toner particles are charged by their friction with the insulator 136. The charge polarity on the toner particles is assumed to be negative in this embodiment.

Meanwhile, the drum 2 is driven in a direction indicated by an arrow F and formed with a latent image electrostatically thereon by a device not shown. In this embodiment, the latent image on the drum 2 is constituted by positive charges.

When the rotating sleeve 130 conveys the charged toner 140 to the developing station D where the sleeve 130 becomes nearest to the drum 2, the toner 140 is electrostatically adhered to the latent image on the drum 2 to turn it into a visible toner image. In this instance, it will be seen that the microelectrodes 134 on the sleeve 130 serve the function previously discussed with reference to FIGS. 10*a* and 10*b*, promoting development of picture and line latent images both in the desired condition (see FIG. 9). The conductive support 132 of the sleeve 130 is supplied with a bias voltage from a power source 142. Advantageously, the bias voltage is predetermined to be somewhat higher than the potential in background areas on the photoconductive layer 144 of the drum 2.

In an alternative arrangement shown in FIGS. 15 and 16, a dielectric layer 146 is deposited to a suitable thickness on the conductive support 132 of the charging sleeve 130. The microelectrodes 134 consist of an iron powder whose particle size is preferably 100 microns as in the embodiment of FIG. 14. Precoated with insulating resin, the microelectrodes 134 are securedly mounted on the dielectric layer 146 of the sleeve 130 in one or two successive layers by an insulating material 136 such as resin. In operation, this developing apparatus processes a latent image in exactly the same way as the apparatus of FIG. 13.

In FIGS. 15 and 16, the dielectric layer 146 and insulator 136 on the sleeve 130 may individually be formed of an elastic composition to render the surface of the sleeve 130 suitably elastic. This will prove effective when the drum is made of such a hard material as selenium, since the sleeve 130 can be safely held in pressing contact with the drum 2 during development. Hence, there can be avoided time consuming work which would otherwise be required for accurately determining a gap between the sleeve 130 and the drum 2. Naturally, the insulator 136 shown in FIG. 14 may also be made of an elastic material to achieve the same effect. The rest of the construction shown in FIG. 15 may be exactly the same as that indicated in FIG. 13.

While the embodiments shown in FIGS. 13–16 have commonly employed a non-magnetic toner, it will be apparent that the present invention is applicable in the same way to a developing apparatus which uses a magnetic toner. In such a case, a magnet will be accommodated within the toner conveying sleeve and at least one of the magnet and toner conveying sleeve will be driven for rotation to convey the magnetic toner. Also, the principle of the present invention will not affected if use is made of a toner having a relatively low electric resistance (e.g. volume specific resistance lower than $10^{10}$ Ω-cm); the toner will be charged by a latent image through electrostatic induction to be deposited on the latent image.

Referring to FIG. 17, there is shown a toner charging member 170 which comprises a cylindrical conductive support 172, an insulating layer 174 deposited on the support 172 and an insulating sheet 176 covering the insulating layer 174. A number of microelectrodes 178 made of a conductor are arranged in a given pattern on the insulating sheet 176. The insulating sheet 176 with the microelectrodes 178 may be produced by preparing an integral assembly of a conductive layer and an insulating sheet, and then etching the conductive layer to form the microelectrodes 178 on the insulating sheet to a desired pattern. Since the resultant microelectrodes 178 slightly bulge from the insulating sheet 176, it will be advantageous to make the surface of the finished sleeve 130 sufficiently smooth by covering the surface of the insulating sheet with a thin insulative coating after the etching process.

The insulating sheet 176 in FIG. 17 does not form any essential part of the construction. The charging sleeve 170 may be formed by preparing an integral assembly of the conductive support 172, insulating layer 174 and a conductive layer covering the insulating layer 174, and then etching the conductive layer to leave the microelectrodes 178. Again, the outer periphery of the sleeve 170 should favorably be coated with an insulating material after the etching process.

Though the toner charging member has been shown in FIGS. 13–17 as comprising a sleeve, it will be apparent to those skilled in this art that it may take the form of a belt. As seen from the embodiments of FIGS. 15–17, the microelectrodes on the conductive support may be located only in that part of the charging member which is adjacent to the photoconductive member. This will be well understood from the discussion concerned with FIG. 10*a*.

FIG. 18 illustrates still another embodiment of the present invention. As shown, a toner charging member 180 in the form of a sleeve or a belt comprises a conductive support 182, an insulating layer 184 of resin or the like deposited on the conductive support 182, and numerous microelectrodes 186 embedded in the insulating layer 184. Toner particles (not shown) are positioned between the charging member 180 and the photoconductive drum 2. A characteristic feature of this embodiment resides in that each microelectrode 186 extends in substantially parallel with the outer periphery of the drum 2 at its portion 186*a* which opposes the drum 2. Apart from the edge effect already analyzed, this construction reproduces images which are more clear-cut than those which would be provided by the apparatuses shown in FIGS. 13–16 using spherical microelectrodes.

To clear out the advantage of the microelectrodes shown in FIG. 18, reference will also be made to FIG. 19 which is a view similar to FIG. 18 but showing spherical microelectrodes 192 on a toner charging member 190. In the arrangement of FIG. 19, those portions 192*a* of the microelectrodes 192 which face the drum 2 are not parallel to the surface of the drum 2 due to the spherical configuration. In this situation, a latent image L on the drum 194 develops an electric field as indicated by arrows in FIG. 19 by way of example. Electric lines of force emanating from a region adjacent to an edge q of the latent image L describe curves and, as will be seen from observation of an electric line of force W for instance, they are noticeably inclined toward the drum surface. This is because the electric line of force W is directed perpendicular to the microelectrode portion 192*a* which is not parallel to the drum surface. Let us assume a situation that, as schematically shown in FIG. 12, a toner particle 200 of predetermined diameter is positioned in the vicinity of the drum 2. In this case, the center of the toner particle 200 is offset a distance l from the edge q of the latent image L along the drum surface. An electric force F acts on the toner particle 200 due to the charge of the latent image L and, since the aforesaid electric line of force W is inclined, the force F has a component which is parallel to the drum surface. In detail, the electric force F has a component Fx in a direction X parallel to the drum surface and a component Fy in a direction Y perpendicular to the drum surface. The component Fy urges the toner particle 200 toward the drum surface. As seen in FIG. 20, this component Fy is directed to a point P on the drum surface which is spaced the distance l from the edge q of the latent image. For this reason and since the toner particle has the illustrated diameter, the toner particle will become adhered to the point P when brought into contact therewith. Stated another way, the toner particle 200 will adhere to the drum at a position offset to the right from the edge q of the latent image by the distance l missing the defined area of the latent image L. This phenomenon occurs on a large number of similar toner particles to consequently blur edge portions of a reproduced image.

Conversely, in the construction of FIG. 18 wherein the microelectrode portions 186*a* facing the drum 2 extend substantially in parallel with the drum surface, all the electric lines of forces but those emanating from a region quite close to the edge q of the latent image L are allowed to advance substantially rectilinearly to the microelectrode portions 186*a*. Under this condition, if the toner particle 200 is positioned in the same manner as in FIG. 20, it will be seen from FIG. 21 that the toner particle 200 is substantially free from any force and, therefore, hardly allowed to adhere to the position on the drum offset from the latent image L. This drastically suppresses blurring of edge regions of reproduced images, that is, promotes reproduction of sharp images.

In connection with FIGS. 20 and 21, it should be born in mind that they only demonstrate a general tendency of toner particles in adhering to a latent image, taking an extreme case for example to promote understanding of the construction of FIG. 18.

The arrangement shown in FIGS. 17 or 18 is of course applicable to a developing apparatus which uses a magnetic toner or a non-magnetic toner. The microelectrodes employed in the various embodiments may be formed of any suitable conductive material other than iron; the conductive material may be magnetic or non-magnetic. It should be noted, however, that in the case of a developing apparatus using a magnetic toner, use of magnetic microelectrodes might have magnetic influence on the toner. Where this influence is substantial, it is preferable to employ non-magnetic microelectrodes.

The inter-microelectrode insulation in the embodiments has relied on resinous coatings on particles which constitute microelectrodes, or insulating resin for rigidly mounting the particles to a conductive support. Alternatively, a mixture of suitable insulating fine particles and conductive particles may be caused to bind together on a conductive support or a prebound bound mixture of the same may be layed on the conductive support to utilize the conductive particles as microelectrodes.

It will be seen from the foregoing that, in accordance with the present invention, a latent image can be developed into a toner image in a manner optimum for its specific total area if a plurality of electrically floating and mutually insulated microelectrodes are disposed on a conductive support of a toner charging member and at least in that portion of the latter adjacent to a latent image.

Various modifications will become possible for those skilled in the art after receiving the teachings of the present disclosure without departing from the scope thereof. For example, the toner charging member may take the form of a belt instead of a sleeve. The toner charging member in the form of a sleeve or a belt may be held stationary so that a magnet accommodated thereinside rotates relative to the charging member. Alternatively, the charging member may be rotated as well as the magnet. The charging member may comprise a single member capable of frictionally charging toner particles to a selected polarity, in place of an assembly of a support and an outer layer as in the embodiments. An arrangement may be made such that toner particles deposited on the charging member are conveyed by a magnet accommodated in the charging member. It will be readily understood that the principle of the present invention is applicable not only to an electronic copying machine but to an electrostatic recording apparatus and, also, to an apparatus in which a latent image is carried on a belt in place of a drum.

What is claimed is:

1. An electrostatographic apparatus including a photoconductive member and means for forming an electrostatic image on the photoconductive member, constituted by comprising:

applicator means having an electrically insulative surface adapted to electrostatically adhere a toner thereto, the insulative surface being movable relative to the photoconductive member for applying the toner thereto for developing the electrostatic image into a toner image;

removal means for removing residual toner from the insulative surface after said development; and discharging means for electrically discharging the insulative surface after removal of the residual toner.

2. An electrostatographic apparatus as claimed in claim 1, in which the discharging means is electrically grounded.

3. An electrostatographic apparatus as claimed in claim 1, in which the discharging means comprises an electrically conductive brush.

4. An electrostatographic apparatus as claimed in claim 3, in which the brush is electrically grounded.

5. An electrostatographic apparatus as claimed in claim 3, in which the brush brushingly engages the insulative surface.

6. An electrostatographic apparatus as claimed in claim 1, in which the discharging means is spaced from the insulative surface by a distance which is small enough to allow electric discharge between the insulative surface and the discharging means.

7. An electrostatographic apparatus as claimed in claim 1, in which the discharging means comprises corona discharging means.

8. An electrostatographic apparatus as claimed in claim 1, in which the photoconductive member comprises a rotary member having an endless photoconductive surface, the applicator means comprising a rotary member having an endless surface which is constituted by the insulating surface, the rotary members of the photoconductive member and the applicator means being disposed adjacent to each other for relative rotary movement.

9. An electrostatographic apparatus as claimed in claim 8, in which the removal means is fixedly disposed adjacent to the rotary member of the applicator means.

10. An electrostatographic apparatus as claimed in claim 8, in which the discharging means is fixedly disposed adjacent to the rotary member of the applicator means.

11. An electrostatographic apparatus as claimed in claim 8, in which the rotary member of the applicator means is hollow.

12. An electrostatographic apparatus as claimed in claim 11, in which the applicator means further comprises at least one magnet disposed inside the rotary member thereof.

13. An electrostatographic apparatus as claimed in claim 8, further comprising magnetic brush means for applying the toner to the rotary member of the applicator means and receiving the residual toner therefrom.

14. An electrostatographic apparatus as claimed in claim 13, in which the removal means comprises scraper means for scrapingly removing the residual toner from the rotary member of the applicator means and guiding the residual toner to the magnetic brush means.

15. An electrostatographic apparatus as claimed in claim 14, in which the discharging means is fixedly disposed downstream of the removal means and upstream of a position where the magnetic brush means applies the toner to the rotary member of the applicator means in a direction of rotation of the rotary member of the applicator means.

16. An electrostatographic apparatus as claimed in claim 15, in which the discharging means comprises an electrically conductive brush.

17. An electrostatographic apparatus as claimed in claim 16, in which the scraper means is electrically conductive, the scraper means and the brush being electrically grounded.

18. An electrostatographic apparatus as claimed in claim 17, in which the scraper means and the brush are integrally mounted.

19. An electrostatographic apparatus as claimed in claim 13, in which the removal means comprises the magnetic brush means and means for applying an electric potential to the magnetic brush means having a polarity and magnitude selected to cause transfer of the residual toner from the rotary member of the applicator means to the magnetic brush means.

20. An electrostatographic apparatus as claimed in claim 1, in which the applicator means further comprises microelectrode means distributatively embedded in the insulative surface.

21. An electrostatographic apparatus as claimed in claim 1, in which the toner is a one-component, magnetic toner having high electrical resistivity.

* * * * *